US008766861B2

(12) United States Patent
Chen

(10) Patent No.: US 8,766,861 B2
(45) Date of Patent: Jul. 1, 2014

(54) ELECTRONIC DEVICE WITH STRUCTURE FOR ENHANCING ANTENNA PERFORMANCE

(75) Inventor: I-Chia Chen, New Taipei (TW)

(73) Assignee: Hon Hai Precision Industry Co., Ltd., New Taipei (TW)

( * ) Notice: Subject to any disclaimer, the term of this patent is extended or adjusted under 35 U.S.C. 154(b) by 126 days.

(21) Appl. No.: 13/527,892

(22) Filed: Jun. 20, 2012

(65) Prior Publication Data

US 2013/0141285 A1 Jun. 6, 2013

(30) Foreign Application Priority Data

Dec. 5, 2011 (TW) ..... 100144741 A

(51) Int. Cl.
*H01Q 1/24* (2006.01)

(52) U.S. Cl.
USPC ..... 343/702; 343/700 MS

(58) Field of Classification Search
USPC ..... 343/700 MS, 702, 829, 846
See application file for complete search history.

(56) References Cited

U.S. PATENT DOCUMENTS

| | | | | |
|---|---|---|---|---|
| 5,914,690 | A * | 6/1999 | Lehtola et al. | 343/702 |
| 5,995,052 | A * | 11/1999 | Sadler et al. | 343/702 |
| 6,741,214 | B1 * | 5/2004 | Kadambi et al. | 343/700 MS |
| 6,982,675 | B2 * | 1/2006 | Kwak et al. | 343/702 |
| 7,183,980 | B2 * | 2/2007 | Chang et al. | 343/700 MS |
| 7,755,545 | B2 * | 7/2010 | Takei et al. | 343/702 |
| 8,502,741 | B2 * | 8/2013 | Lin et al. | 343/702 |

FOREIGN PATENT DOCUMENTS

CN 1682406 A 10/2005

* cited by examiner

*Primary Examiner* — Tho G Phan
(74) *Attorney, Agent, or Firm* — Novak Druce Connolly Bove + Quigg LLP

(57) ABSTRACT

An electronic device with structure for enhancing antenna performance includes a base cover with rectangle-shaped, a metal plate setting on the base cover, three metal strips, and three conductive patches. The metal plate is rectangle-shaped and includes a first side, a second side, and a third side, the first side is paralleled to the second side. The three metal strips are respectively paralleled to one side of the base cover and the first side, the second side, and the third side of the metal plate to constitute a frame to limit the metal plate. Two of the three conductive patches are electrically contacted with both of the metal plate and the metal strip contacted to the first side, the other conductive patch is electrically contacted with both of the metal plate and the metal strip contacted to the second side.

7 Claims, 2 Drawing Sheets

ELECTRONIC DEVICE WITH STRUCTURE FOR ENHANCING ANTENNA PERFORMANCE

BACKGROUND

1. Technical Field

The present disclosure relates to electronic devices, particularly, to an electronic device with a structure for enhancing its antenna performance.

2. Description of Related Art

Electronic devices, such as mobile phones, digital photo frames, and electronic readers, are usually equipped with an antenna, and a display panel, such as liquid crystal display panel, or an LED panel. As shown in FIG. 2, a common electronic device 1' includes a metal plate 10' set on a base cover 2', the metal plate 10' is used to be attached behind a display panel (not shown) of the electronic device 1' to protect the display panel. Usually, the base cover 2' also sets three metal strips 20', the three metal strips 20' respectively are paralleled to one side of the base cover 2' and constitute a frame to limit the metal plate 10'. Each of the metal strips 20' includes several annular protrusion portions 201', these annular protrusion portions 201' are used to match corresponding structures of a front cover (not shown) of the electronic device 1' and then make the front cover are fixed connected to the back cover 2'. However, because the metal strips 20' are surface contacted to the metal plate 10', when the electronic device 1 are started up or in the process of communication, there are surface current flowing through the metal plate 10' and the metal strips 20'. The annular protrusion portions 201' produce magnetic field, thus enhancing specific absorption rate (SAR) and enhancing intensities of electromagnetic radiation. The gaps between the metal plate 10' and the metal strips 20' produce antenna noise and reduce the antenna performance.

An electronic device with structure for enhancing antenna performance to overcome the described limitations is thus needed.

BRIEF DESCRIPTION OF THE DRAWINGS

Many aspects of the present disclosure are better understood with reference to the following drawings. The components in the drawings are not necessarily drawn to scale, the emphasis instead being placed upon clearly illustrating the principles of the present disclosure.

Moreover, in the drawings, like reference numerals designate corresponding parts throughout the several views.

DETAILED DESCRIPTION

Embodiments of the present disclosure will be described, with reference to the accompanying drawings.

Figure 1:
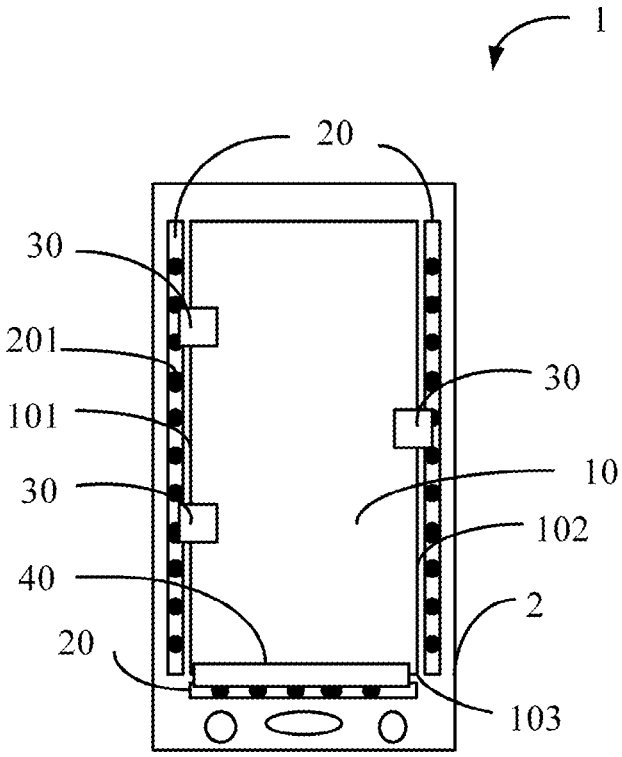
FIG. 1 is an isometric view showing components of a base cover of an electronic device, with a front cover omitted for clarity, in accordance with an exemplary embodiment.
Figure 2:
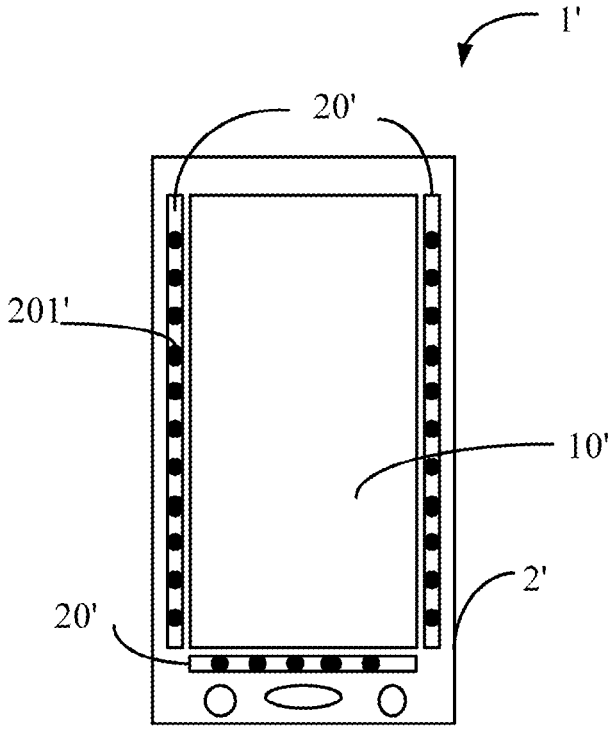
FIG. 2(related art)
FIG. 2 is an isometric view showing components of a base cover of an electronic device of a related art, with a front cover omitted for clarity.

Referring to FIG. 1, an electronic device 1 with structure for enhancing its antenna performance is provided. The electronic device 1 includes a base cover 2, a metal plate 10, and three metal strips 20. The metal plate 10 is set on the base cover 2. The shapes of the metal plate 10 and the base cover 2 are rectangles. The three metal strips 20 are paralleled to three sides of the base cover 2 and constitute a frame to limit the metal plate 10. In the embodiment, the three metal strips 20 are respectively paralleled to and contact with a first side 101, a second side 102, and a third side 103 of the metal plate 10, and the length of the three metal strips 20 are respectively equal to the first side 101, the second side 102, and the third side 103 of the metal plate 10. Each metal strips 20 includes several annular protrusion portions 201, these annular protrusion portions 201 are used to match corresponding structures of a front cover (not shown) of the electronic device 1 and fixedly connect the front cover to the back cover 2.

In the embodiment, the electronic device 1 also includes three conductive patches 30. Two of the three conductive patches 30 are located on the first side 101 of the metal plate 10, and are electrically contacted with both of the metal plate 10 and the metal strips 20 contacted to the first side 101. The other conductive patch 30 is located on the second side 102 of the metal plate 10 paralleled to the first side 101, and is electrically contacted with both of the metal plate 10 and the metal strips 20 contacted to the second side 101. The three conductive patches 30 form three conductive points between the metal plate 10 and the corresponding conductive strips 20 as shown in FIG. 1, thus breaking the surface contact between the metal plate 10 and the corresponding metal strips 20.

Therefore, The surface current flowing through the metal plate 10 and the conductive strips 20 produced due to the electronic device 1 is started up or in the process of communication is interfered, and the magnetic field produced by the annular protrusion portions 201 is reduced. Thus the SAR and the intensities of electromagnetic radiation are reduced.

In the embodiment, the shape of the conductive patches 30 can be rectangle, round, triangle, and the size of the conductive patches 30 are much smaller than the size of the metal plate 10.

In the embodiment, the electronic device 1 also includes a strip-shaped conductive patch 40. The strip-shaped conductive patch 40 is located on the metal plate 10 and is paralleled to the third side 103 of the metal plate 10. The strip-shaped conductive patch 40 is electrically contacted with both of the metal plate 10 and the metal strips 20 contacted to the third side 103. In the embodiment, the length of the strip-shaped conductive patch 40 is equal to the length of the third side 103 of the metal plate 10. The strip-shaped conductive patch 40 makes the metal strips 20 contacted to the third side 103 be completely contacted to the metal plate 10. Therefore, the gaps between the metal plate 10 and the metal strips 20 are decreased, thus enhancing the antenna performance In the embodiment, the conductive patches 30 and the strip-shaped conductive patch 40 can be made of copper, iron, aluminum, silver or other metal.

As shown in FIG. 1, the first and second sides 101, 102 are the long sides of the metal panel and the third side 103 is the short side of the metal panel 10. It is obvious that the first side 101, the second side 102 can be the short sides of the metal panel and the third side 103 can be the long side of the metal panel 10.

In the embodiment, the electronic device 1 can be a mobile phone, a personal digital assistant, an electronic reader, or a digital photo frame, which includes the display panel and with the communication function.

It is believed that the present embodiments and their advantages will be understood from the foregoing description, and it will be apparent that various changes may be made thereto without departing from the spirit and scope of the disclosure or sacrificing all of its material advantages, the examples hereinbefore described merely being exemplary embodiments of the present disclosure.

What is claimed is:

1. An electronic device with structure for enhancing antenna performance, comprising:

a base cover with a rectangular shape;

a metal plate setting on the base cover, wherein, the metal plate is rectangle-shaped and comprises a first side, a second side, and a third side, the first side is paralleled to the second side;

three metal strips respectively paralleled to three sides of the base cover and constitute a frame to limit the metal plate, wherein, the three metal strips are further respectively paralleled to and contact with the first side, the second side, and the third side of the metal plate; and three conductive patches;

wherein, two of the three conductive patches are located on the first side of the metal plate, and are electrically contacted with both of the metal plate and the metal strip contacted to the first side, the other conductive patch is located on the second side of the metal plate paralleled to the first side, and is electrically contacted with both of the metal plate and the metal strip contacted to the second side.

2. The electronic device with structure for enhancing antenna performance according to claim 1, further comprising a strip-shaped conductive patch, the strip-shaped conductive patch is located on the metal plate and is paralleled to the third side of the metal plate, the strip-shaped conductive patch is electrically contacted with both of the metal plate and the metal strip contacted to the third side, and makes the metal strip contacted to the third side be completely contacted to the metal plate.

3. The electronic device with structure for enhancing antenna performance according to claim 2, wherein the conductive patches and the strip-shaped conductive patch are made of copper, iron, aluminum, or silver.

4. The electronic device with structure for enhancing antenna performance according to claim 2, wherein the length of the strip-shaped conductive patch is equal to the length of the third side of the metal plate.

5. The electronic device with structure for enhancing antenna performance according to claim 4, wherein the shape of the conductive patches is rectangle, round or triangle, and the size of the conductive patches is much smaller than the size of the metal plate.

6. The electronic device with structure for enhancing antenna performance according to claim 1, wherein the electronic device is selected from the group consisting of a mobile phone, a personal digital assistant, an electronic reader, and a digital photo frame.

7. The electronic device with structure for enhancing antenna performance according to claim 1, wherein the three conductive patches form three conductive points between the metal plate and the corresponding conductive strips, thus breaking the surface contact between the metal plate and the corresponding metal strips.

* * * * *